US007845527B1

(12) United States Patent
McMillan et al.

(10) Patent No.: US 7,845,527 B1
(45) Date of Patent: Dec. 7, 2010

(54) DEVICE FOR CARRYING ARTICLES

(76) Inventors: William Michael McMillan, 41483 Ashburn Rd., Temecula, CA (US) 92591; Mick Strider, 120 N. Pacific St., San Marcos, CA (US) 92069

( * ) Notice: Subject to any disclaimer, the term of this patent is extended or adjusted under 35 U.S.C. 154(b) by 969 days.

(21) Appl. No.: 11/652,269

(22) Filed: Jan. 11, 2007

Related U.S. Application Data

(60) Provisional application No. 60/758,654, filed on Jan. 14, 2006.

(51) Int. Cl.
*B26B 29/02* (2006.01)
*F41B 13/04* (2006.01)

(52) U.S. Cl. ..... 224/232; 224/247; 224/255; 224/901.2; 224/901.8; 224/914

(58) Field of Classification Search ..... 224/232, 224/233, 247, 250, 255, 655, 675, 676, 901.2, 224/901.8, 914
See application file for complete search history.

(56) References Cited

U.S. PATENT DOCUMENTS 3,053,005 A * 9/1962 Byers ..... 43/55
4,815,640 A * 3/1989 Johnson ..... 224/601
5,170,919 A * 12/1992 DeSantis et al. ..... 224/587
5,458,278 A * 10/1995 LaConte ..... 224/651
5,495,967 A * 3/1996 Parton ..... 224/610
5,567,055 A * 10/1996 Smith ..... 383/38
5,724,707 A * 3/1998 Kirk et al. ..... 24/3.7
6,026,646 A * 2/2000 Hansen et al. ..... 62/3.6
6,119,909 A * 9/2000 Dancyger ..... 224/683
6,131,198 A * 10/2000 Westrick ..... 2/102
2003/0218035 A1* 11/2003 Willows et al. ..... 224/148.4
2007/0080182 A1* 4/2007 Thatcher ..... 224/148.4

* cited by examiner

*Primary Examiner*—Nathan J Newhouse
*Assistant Examiner*—Adam Waggenspack
(74) *Attorney, Agent, or Firm*—Robert O. Blinn

(57) ABSTRACT

The device for carrying articles includes a first side portion, a second side portion and a holder unit. The first and second side portions include a means for holding the first and second side portions together. Each of the first and second side portions include an inside face and an outside face. The inside faces of the side portions are at least partially covered with either the hook or loop fabric of a hook and loop fabric fastening system. The holder unit is adapted for fitting between the side portions. At least portions of the sides of the holder unit are covered with corresponding hook or loop fabric appropriate for engaging the hook or loop fabric of the side portions. At least one of the outside faces of the side portions includes provisions for securing the carrying device to a military garment.

3 Claims, 5 Drawing Sheets

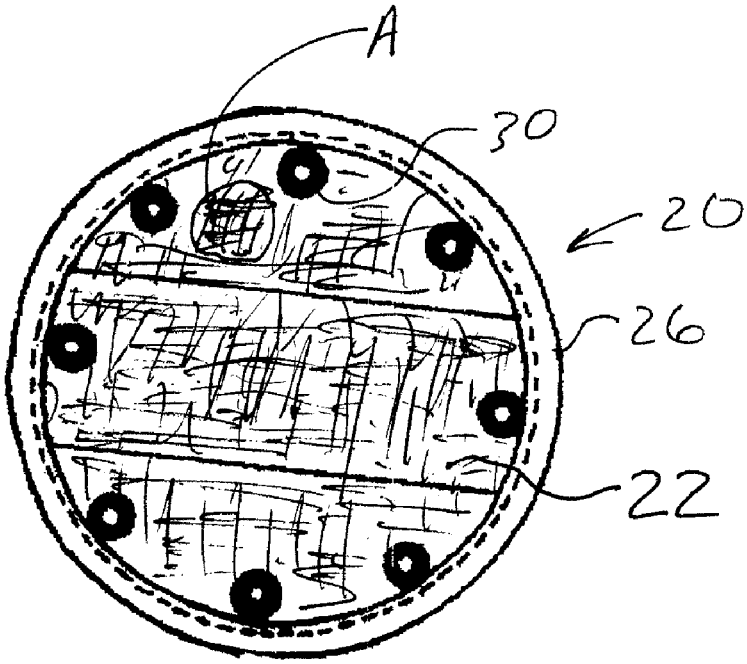
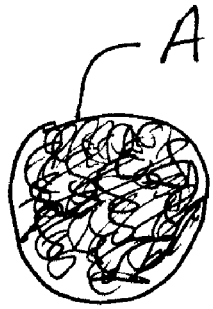
FIG. 3A
FIG. 3
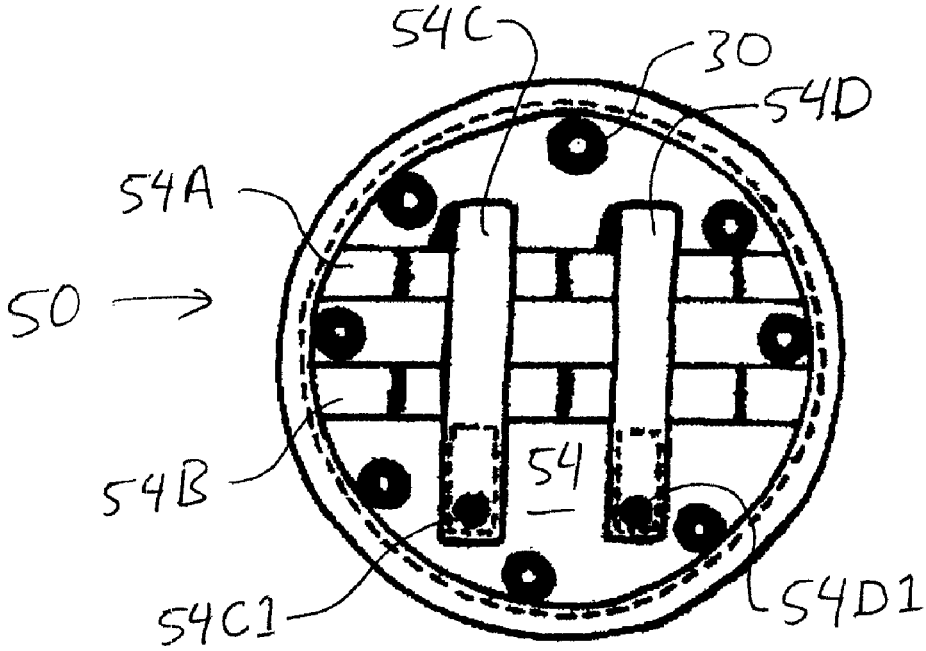
FIG. 4

DEVICE FOR CARRYING ARTICLES

CROSS REFERENCES TO RELATED APPLICATIONS

This application claims the benefit of U.S. Provisional Patent Application No. 60/758,654 filed Jan. 14, 2006.

FIELD OF THE INVENTION

The present invention relates to device for holding and carrying articles such as knives, side arms and other gear, equipment and articles.

BACKGROUND OF THE INVENTION

Knife sheaths and side arm holsters and other such devices which can be carried on the person have long been known for holding and carrying knives, side arms and other gear and equipment. Present holsters and sheaths are often configured for use by right handed individuals. Moreover, even right handed individuals may find that the configuration of a present sheath or holster provides only a limited set of positions and orientations for holding a side arm, a knife or other article. Exterior garment webbing is often provided on the outer portions of garments worn by military personnel thus providing a myriad of attachment locations for various item's of gear. Moreover, soldiers may wish to have universally adjustable and positionable devices for carrying knives, side arms and other articles which can be easily fastened to the webbing present in exterior military garments. A universally positionable and adjustable carrying device would also allow rapid access by both right handed and left soldiers. Moreover, such a universally positionable and adjustable carrying device would allow a soldier to select the position and orientation of a weapon or other article. This would allow the soldier to customize the location and orientation various weapons and articles for rapid retrieval and use.

BRIEF DESCRIPTION OF THE INVENTION

In an embodiment of the present invention the aforementioned needs are addressed by a device for holding articles. The device for carrying articles of the present invention provides a way to support and carry an article such as a knife, a side arm or other item of equipment such that the soldier may select the most desirable location and orientation of the article for retrieval and use. The device for carrying articles includes a first side portion, a second side portion and a holder unit. The first and second side portions include a means for holding the first and second side portions together such as, for example, a pattern of eyelets spaced about the perimeter of each side portion and a draw chord for drawing the side portions together. The first and second side portions each include an inside face that faces toward the other side portion and an outside face that faces away from the other side portion. At least one of the inside faces of the side portions is at least partially covered with one of the hook or loop fabric of a hook and loop fabric fastening system. The side portions can be separated by loosening the draw chord for receiving a holder unit. The holder unit is adapted for receiving and holding an article such as a knife, side arm or other item of gear and thus may take the form of a knife sheath or a side arm holster or other receptacle for receiving an article. At least a portion of the outside surface of the holder unit is covered with the other of the hook or loop fabric selected for covering at least a portion of one of the inside faces of the side portions.

The hook fabric engages the loop fabric so that the holder unit may be fixed between the side portions. The holder unit may be oriented in one of any of a multitude of orientations between the side portions. At least one of the outside faces of the side portions includes provisions for securing the carrying device to a military garment. For example, at least two fastening strips may be provided for threading under the webbing typically covering the outer surfaces of military garments.

BRIEF DESCRIPTION OF THE DRAWINGS

FIG. 3 is a front side view of the device for carrying articles taken from plane 3-3 of FIG. 1.

FIG. 3A is a magnified view of areas A indicated in FIGS. 1 and 3 providing a magnified view of the loop fabric material that is applied to the inside surfaces of the first and second portions.

FIG. 4 is back side view of the device for carrying articles taken from plane 4-4 of FIG. 1.

DETAILED DESCRIPTION

Figure 1:
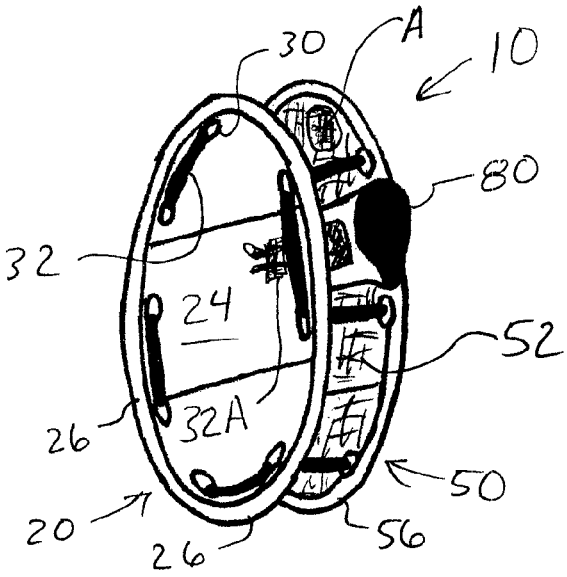
FIG. 1 is a perspective view of an embodiment of the device for carrying articles.

Referring to the drawings, FIG. 1 shows an embodiment of the device for carrying articles of the present invention 10. The preferred embodiment shown and described in detail here should be understood as the merely the inventors' preferred embodiment among a multitude of possible embodiments for practicing this invention. As can be seen in FIG. 1, the device for carrying articles 10 includes a first side portion 20 and a second side portion 50. A means is provided for holding first side portion 20 and a second side portion 50 together. In this example, first side portion 20 and second side portion 50 include eyelets 30 spaced about the outer edges of side portions 20 and 50 for receiving a draw chord 32 for drawing and tying side portions 20 and 50 together. A draw chord lock 32A is used to maintain tension in draw chord 32.

In this example, first side portion 20 is fashioned from circular cloth pieces which, for example, may have a diameter of about six inches. Second side portion 50 has a similar shape and size. Side portions 20 and 50, however, may have a shape and size that varies from the example shown and described here. With this example, first side portion 20 includes an inside face 22 and an outside face 24 which are both covered with loop cloth of a hook and loop cloth fastening system such as VELCRO® hook and loop fastening fabric. Hereafter, except in the claims, this loop cloth will be referred to as VELCROloop fabric. The outer edge of first side portion 20 is protected by nylon cloth piping 26. As noted above, first side portion 20 has a pattern of evenly spaced eyelets 30 spaced around its periphery for receiving draw chord 32. Second side portion 50 is similar in construction to first side portion 20 except for the configuration of its outside face which will be described in greater detail below.

Figure 5:
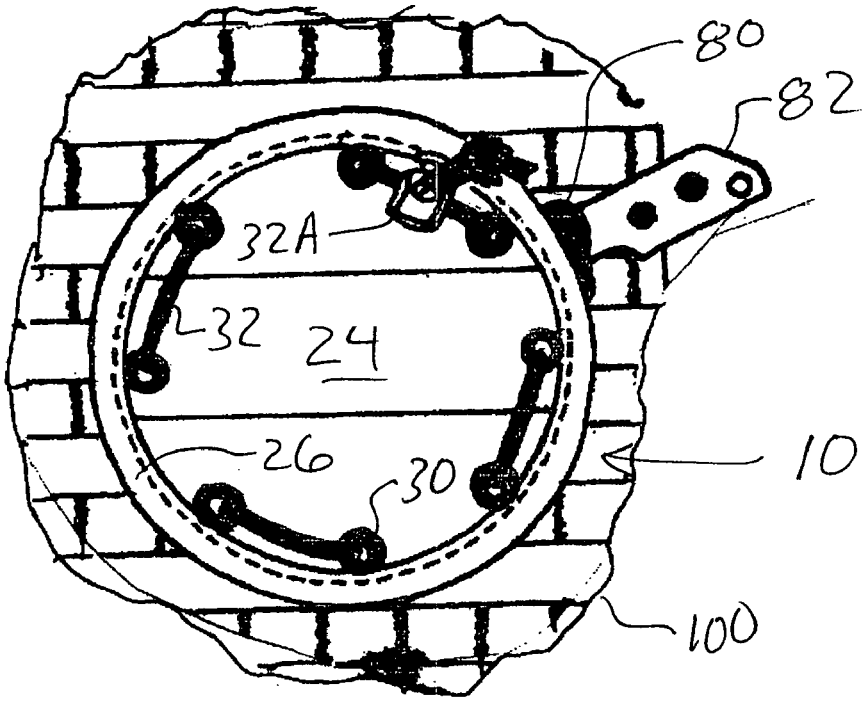
FIG. 5 is a front side view of the device for carrying articles shown mounted to the external webbing of a military garment.
Figure 5A:
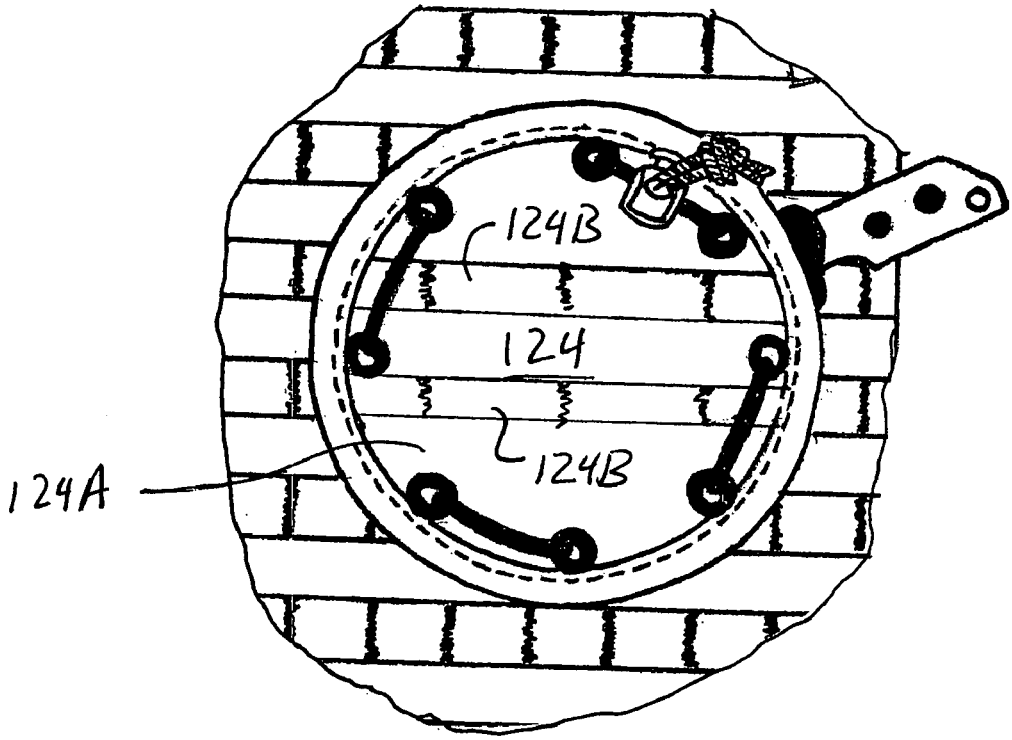
FIG. 5A is a front side view of the device for carrying articles shown mounted to the external webbing of a military garment and shown with an alternate external webbed surface.

FIG. 5A illustrates an alternate outside face 124 for first side portion 20. In this example, outside face 124 is fashioned from heavy nylon fabric substrate 124A and webbing 124B instead of VELCRO® loop fabric. This nylon webbing is referred to by U.S. military personnel as "PALS" webbing. Such PALS webbing may generally include nylon straps 124B which are intermittently sewn to nylon substrate 124A as shown in FIG. 5A.

FIG. 3 provides a plan view of the inside face 22 of first side portion 20. FIG. 4 provides a plan view of the inside face 52 of second side portion 50. Carrying device 10 is arranged such that, when assembled, inside face 22 of first side portion 20 and inside face 52 of second side portion 50 face each other. Preferably, inside face 22 and inside face 52 are covered with loop fabric of a hook and loop fabric fastening system such as the well known VELCRO® hook and loop fastening fabric.

Figure 2:
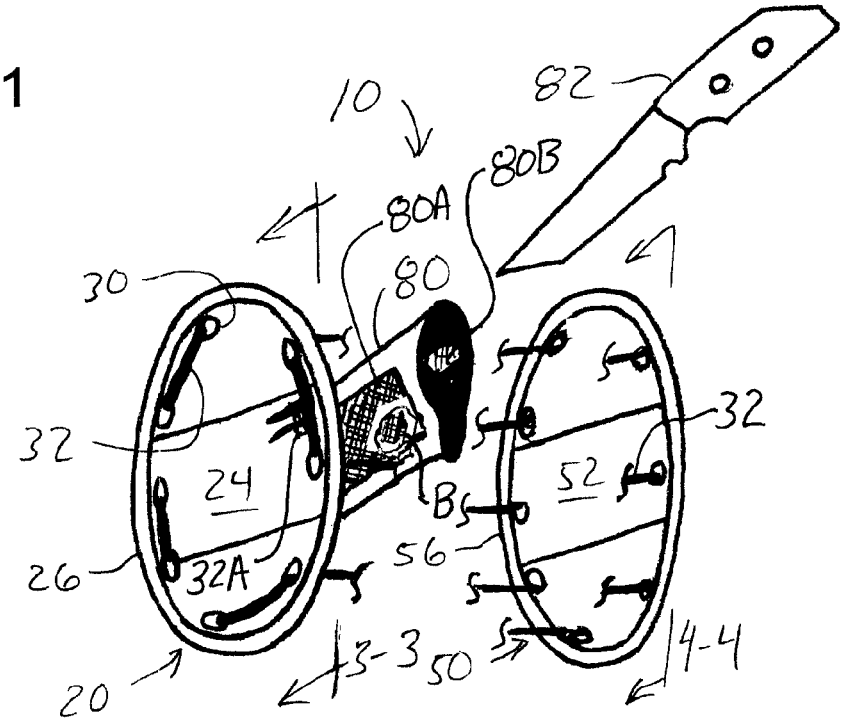
FIG. 2 is an exploded perspective view of an embodiment of the device for carrying articles.
Figure 2B:
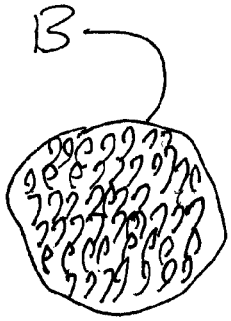
FIG. 2B is a magnified view of area A indicated in FIG. 2 providing a magnified view of the hook fabric material applied to the outside surface of the holder unit.

As is shown in FIG. 2, first side portion 20 and second side portion 50 can be separated for receiving a holder unit 80. Holder unit 80 shown in FIGS. 1-9 is a knife sheath adapted for holding knife 82. But this is merely an example of only one type of a multitude of various holder units that may be devised for use with carrying device 10. A holder unit may be configured to receive a side arm or a water bottle or any one of a large number of articles or gear. Hook fabric areas 80A and 80B at least partially cover the opposite outside surfaces of holder unit 80 and engage the loop fabric covering the inside faces 22 and 52 of side portions 20 and 50 so that holder unit 80 may be fixed between the side portions 20 and 50. In FIG. 2, a portion of hook fabric area 80B on the opposite side of holder unit 80 is shown by breaking out a portion of the opposite wall of holder unit 80. As can be seen in FIG. 2, holder unit 80 may be oriented in one of any of a multitude of orientations.

FIG. 3 provides a plan view of the inside face 22 of first side portion 20. As can be seen in FIG. 3, inside face 22 is covered by VELCRO® loop fabric.

Figure 8:
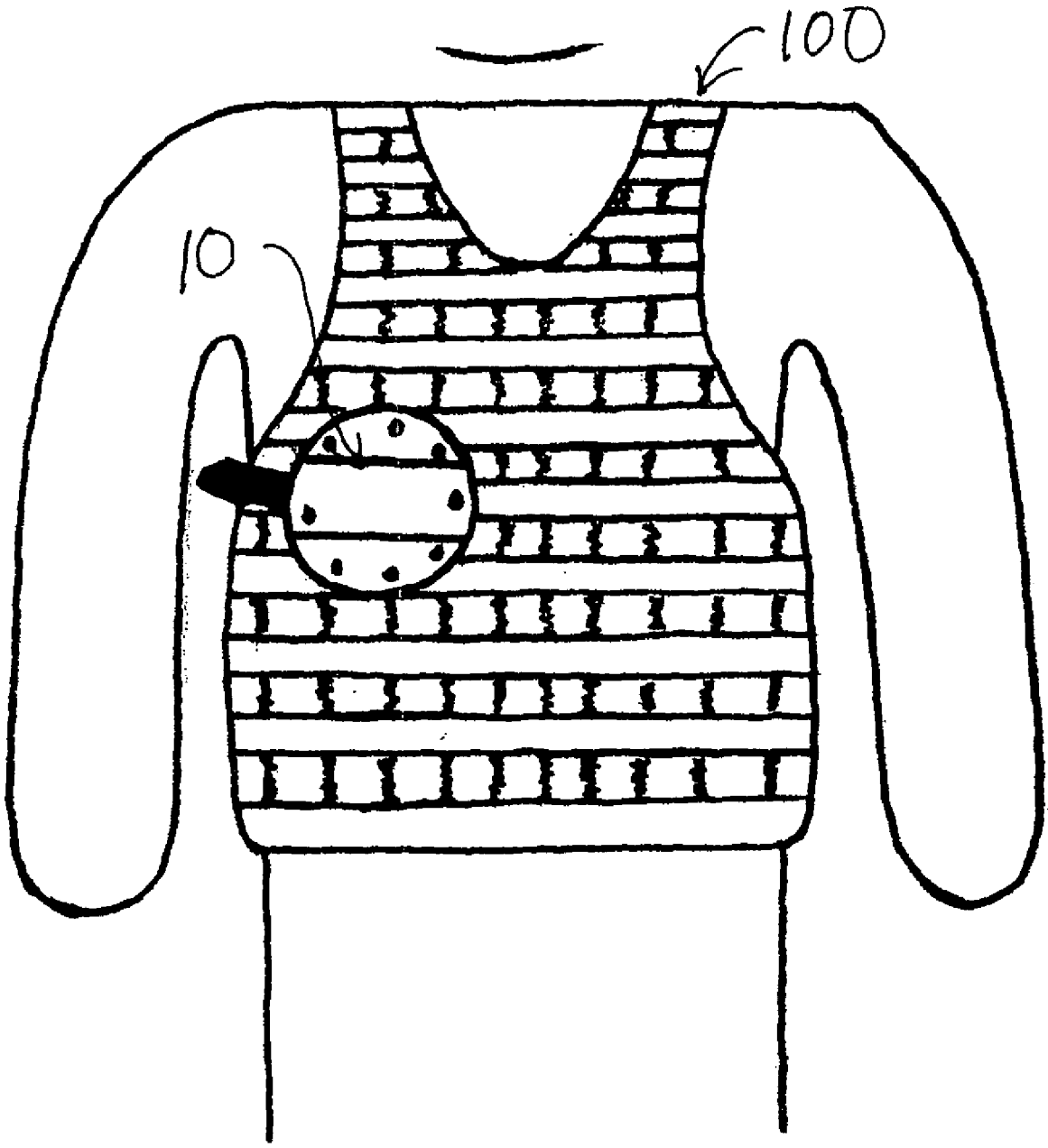
FIG. 8 is a view showing the device for carrying articles as worn by a soldier.

FIG. 4 provides a plan view of the outside face 54 of second side portion 50. As can be seen in FIG. 4, outside face 54 is preferably fashioned from a tough nylon fabric. Two optional nylon cloth strips of webbing 54A and 54B run generally horizontally across outside face 54. A means is provided for securing carrying device 10 to a military garment. In the embodiment shown in FIG. 4, two fastening strips 54C and 54D are fixed at one of their ends to outside face 54 and are connected at their opposite ends by releasable snap fasteners 54C1 and 54D1. As can be seen in FIGS. 5 and 8, fastening strips 54C and 54D can be threaded through the webbing of a military garment to mount carrying device 10 to a military garment 100. Accordingly, the width, thickness and spacing of fastening strips 54C and 54D are preferably adapted for threading through the webbing of a military garment.

Figure 6:
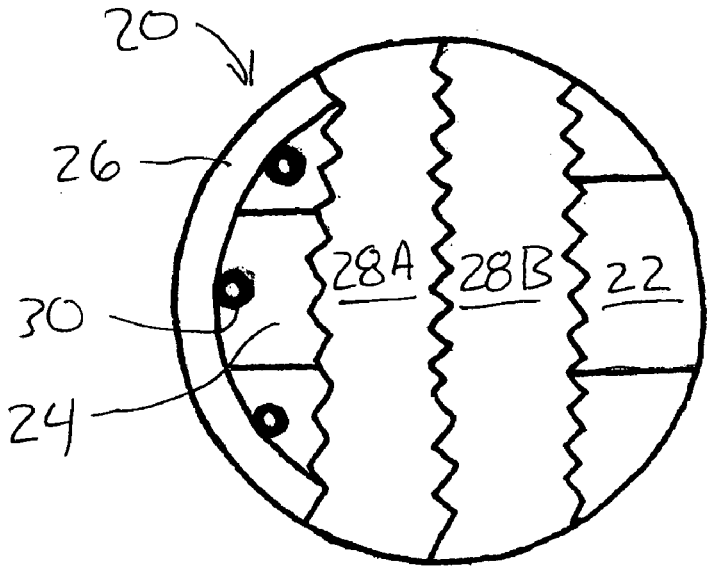
FIG. 6 is a cut away view showing the internal structure of the first side portion of the device for carrying articles.

FIG. 6 provides a cut away view of first side portion 20. As can be seen in FIG. 6, first side portion 20 includes outside face 24. Outside face 24 may fashioned from VELCRO® loop fabric or in the alternative outside face 24 may be replaced by an optional outside face 124 fashioned from PALS webbing as described above and shown in FIG. 5A. The second and third internal layers 28A and 28B of first side portion 20 are fashioned from heavy nylon cloth. It is preferable that 1000 CORDURA® fabric is used for second and third internal layers 28A and 28B. Inside face 22 of first side portion 20, like outside face 24 is fashioned from VELCRO® loop fabric.

Figure 7:
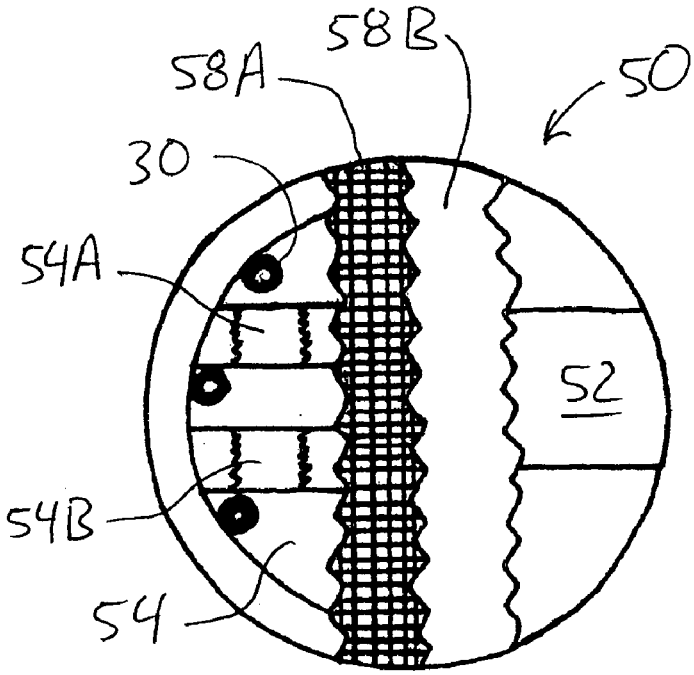
FIG. 7 is a cut away view showing the internal structure of the second side portion of the device for carrying articles.

FIG. 7 provides a cut away view of second side portion 50. As can be seen in FIG. 7, outside face 54 is fashioned from nylon fabric. CORDURA® fabric is the preferred fabric for outside face 54. Optionally, outside face 54 includes nylon webbing comprised of nylon straps 54A and 54B which are intermittently sewn to outside face 54. A plastic stiffener 58A is placed under outside face 54. A heavy nylon fabric layer 58B, preferably fashioned from 1000 CORDURA® fabric, is placed under plastic stiffener 58A. Inside face 52 is located under nylon fabric layer 58B and, as noted above, inside face 52 is fashioned from VELCRO® loop fabric.

The objectives of the invention are satisfied by carrying device which may be adapted for carrying a wide variety of holding units which are in turn adapted for receiving and carrying such items as knives, side arms, flash lights and other items of equipment and gear. As can be seen from the above description, the holding unit may be oriented in an orientation desired by the user and the carrying device itself may be located on any portion of exterior garment webbing thus optimizing the accessibility of an item carried by the carrying device. In the case of an item needed for self defense or combat, ease of access and use may translate increased rates of success and survival for soldiers using the carrying device of the present invention.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A device for holding a knife, comprising:

a knife sheath operable for receiving and holding a knife, the knife sheath having an outside surface having two opposite sides with both opposite sides presenting one of a hook or loop fabric of a hook and loop fabric fastening system, a first side portion and a second side portion, the first and second side portions fashioned from fabric and having internal reinforcement so that the first and second side portions are generally rigid, the first and second side portions having generally the same shape and size, each side portion having an inside face and an outside face, the first and second side portions being separate pieces and arranged in a side by side spaced apart relationship, a plurality of eyelets suitable for receiving a draw chord generally evenly distributed around the entire outer edges of the first and second side portions, the draw chord threaded through alternating eyelets of opposite side portions thereby presenting a draw chord that is manually pulled in order to releaseably secure the side portions together and in order to pull the side portions toward each other and a draw chord lock operable for retaining the draw chord to hold the side portions together, the inside face of each side portion presenting a surface generally covered by hook or loop fabric selected for engaging the other of the hook or loop fabric on the outside surface of the knife sheath, such that when the knife sheath is secured between the first and second side portions as the draw chord is tightened and pulls the side portions toward each other, the knife sheath is securely held therebetween and thereby presented for receiving and holding a knife, and, a means for securing the device to a garment, whereby a user may secure the device to the user's garment in a desired location and a desired orientation in order to facilitate the user's access to the knife.

2. The device of claim 1 wherein:

the garment of the user includes external webbing and the means for securing the device to the garment of the user includes a pair of spaced fastening strips suitable for threading through the external webbing of the garment of the user and fastening the device to the webbing of the garment.

3. The device of claim 1 wherein:

the first and second side portions are circular.

* * * * *